United States Patent [19]

Lewis

[11] 4,433,206

[45] Feb. 21, 1984

[54] EMI SHIELDED CONNECTOR ASSEMBLY

[75] Inventor: John Lewis, Binghamton, N.Y.

[73] Assignee: The Bendix Corporation, Southfield, Mich.

[21] Appl. No.: 329,154

[22] Filed: Dec. 10, 1981

[51] Int. Cl.[3] ..... H01R 13/658

[52] U.S. Cl. ..... 174/356; 174/76; 339/143 R

[58] Field of Search ..... 174/35 C, 76, 75 C, 174/89; 339/143 R, 218 R, 218 M

[56] References Cited

U.S. PATENT DOCUMENTS

| | | | |
|---|---|---|---|
| 3,643,208 | 2/1972 | Massa, Jr. | 339/143 R X |
| 3,744,128 | 7/1973 | Fisher et al. | 29/883 X |
| 4,025,145 | 5/1977 | Shaffer et al. | 339/143 R |

*Primary Examiner*—J. V. Truhe
*Assistant Examiner*—D. A. Tone
*Attorney, Agent, or Firm*—Russel C. Wells; Raymond J. Eifler

[57] ABSTRACT

An EMI shielded connector assembly for a cable connector is formed of aluminum and has an aperture 44 therein to receive potting compound 46 to secure the wires 28 to the connector body. The braided inner cover 26 of the cable 24 is formed into a pig tail 34 and is secured in the back-shell 40 by the potting compound 46. Between the braided inner cover 26 and the braided outer cover 30 which is the braided shield, a ferrule member 60 is positioned on the cable and the outer cover 30 is braided over the ferrule member 60. Next the ferrule clamping member 62 is positioned over the ferrule member 60 in such a position that the groove 68 overrides the ring 66. The two ferrule member 60 and 62 are pressed together and form a strain relief means 38. The strain relief means 38 is welded 42 to the back-shell 40 and a rivet 48 plugs the potting aperture 44 in the back-shell 40 after which a rubberized boot 50 is formed over the enclosure. Prior to forming the boot 50, the back-shell 40 is staked or secured to the connector body. The result is a solid, secure EMI shielded enclosure for a cable connector and operates with either a straight or elbow back-shell 40.

5 Claims, 3 Drawing Figures

EMI SHIELDED CONNECTOR ASSEMBLY

The invention relates to electrical cable connection and more particularly to electro magnetic interference shielding (EMI) for cable connectors.

In many electronic assembly applications, there is a demand for stringent shielding of electrical circuits, in particular with the wiring associated with such circuits while simultaneously protecting the wiring from being cut. In addition, in most assemblies the space available around the assemblies for connection of cables is at a minimum and therefore the connector and cable assembly must be such as to maintain smallest practicable size while maintaining good electrical contact and good support to prevent breakage of the wires from handling or vibration.

In the assembly of connectors to cables, it is necessary to store on the cable the housing for the connector, which is commonly called the "back-shell", as well as any strain relief means prior to the time of connecting the several contacts to the end of the wires of the cable. When the several contacts are connected to the cables and inserted into the connector body, the back-shell is brought forward and is secured to the connector body. The strain relief means is clamped onto the cable and to the back-shell to secure the cable. Various methods and devices have been used to accomplish this, but the problem faced in this instance is that the size of the shielding wire for the cable is much heavier than normally dealt with thereby requiring a different approach.

In order to solve the problem of providing electromagnetic radiation shielding and to secure the cable shielding and wires to the connector body, the present invention resulted. In order to reduce cost, the back-shell of the present invention is fabricated from aluminum which can be either machined or when production quantities become sufficient can be formed by means of a drawing process. The strain relief means also functions as part of the back-shell and works not only to clamp the cable to prevent it from being pulled out of the back-shell but also provides an enclosure for EMI shielding and a means for grounding the cable shielding. Further the back-shell has been provided with an access aperture or fill-hole to permit a potting compound to be inserted into the back-shell thereby acting to secure the cable to the connector body, to secure or retain the cable within the connector and further to immobilize the wiring to minimize breakage due to vibration.

In particular it is an advantage of the present invention, when working with a cable that has at least one braided cover overlying the jacketed wires of the cable which functions to protect the cable from other environmental conditions such as oil, grease and a second braided cover overlying the first which is a heavy weight metallic shield that is used to prevent EMI radiation, and to provide more abrasion resistance so that the cable is not damaged, to use the EMI shielding enclosure described and claimed herein.

These and other advantages are evident from the following detailed description.

DETAILED DESCRIPTION

Figure 1:
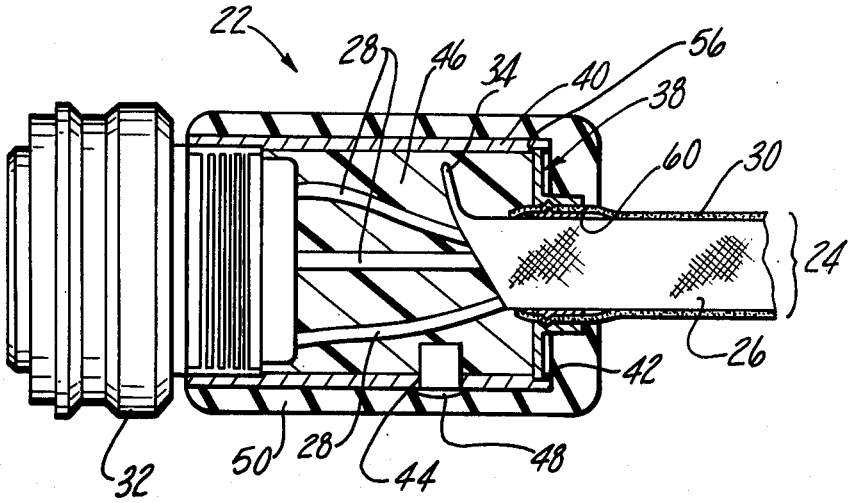
FIG. 1 is a plan view, partially in section, of the present invention.

In referring to the FIGS. by the characters of reference, FIG. 1 is a preferred embodiment of the present invention wherein the connector assembly 22 is illustrated. Connected to the connector assembly 22 is a cable 24 having an abrasive resistant, oil resistant, cover 26 overlying the jacketed wires 28 and further an electromagnetic shielding braid 30 overlying the cover 26. In the connector 22 of FIG. 1 there is illustrated a conventional external ring means 32 which is used to secure the cable mounted connector body to the stationary or panel mounted connector portion of the assembly. As is well known, the ring means 32 typically is internally threaded so as to mate and bring the two connectors together. The connector body, which is not shown, is a conventional connector body wherein the wires 28 of the cable 24 are secured to pins in the connector body by soldering or in the alternative the connector pins are previously crimped to the ends of the wire and they are then inserted into the body.

As illustrated in FIG. 1 the cable comprises a first cover 26 which overlies several individually jacketed wires 28 of the cable 24 of which three wires 28 are illustrated. This cover 26 which is typically non-metallic and is used to protect the cable both from environmental conditions such as oil and grease and from the sharp corners on assemblies which will cut or damage the jacked wires 28 and to protect the jacked wires 28 from the second cover 30. In the preferred embodiment the cover 26 is formed by braiding polytetrafluoroethylene coated fiberglass thread around the jacket wires 28. Overlying the first cover 26 is a second cover or an electro-magnetic shield, so which is typically braided wire which may be very light weight plated copper wire of four or five thousandths inches (0.1016 mm or 0.127 mm) in diameter or as in the present embodiment may be nickel wire of eight thousandths inches (0.2032 mm) in diameter.

As illustrated in FIG. 1 the first cover 26 is terminated in a braiding tail or pig tail 34. The braided tail 34 of the first cover 26 helps hold the cable 24 to the connector 22 so that the jacketed wires 28 are not broken when the connector is removed.

The back-shell 40, the strain relief means 38 and the aperture closing means 48 are all formed out of aluminum. It is not only a lightweight material, but is an effective EMI shield as well as being easy to manufacture. By having the strain relief means 38 a separate part and welded to the back-shell 40 the back-shell can be a cylindrical member opened at either end with a shoulder 56 in one end to receive and locate the strain relief means 38 prior to welding. The other end of the back-shell 40 is positioned on the connector in an interference fit and is secured by means of staking, welding or some other means of fastening. The important thing is that the back-shell 40 becomes an integral part of the connector and is not loose. In addition by being an open cylindrical member the back-shell 40 is easily stored upon on the cable 24 during assembly.

The back-shell 40 of the connector is placed over the connector body assembly in a press fit condition and in the preferred embodiment is then staked to further secure it to the connector body. The strain relief means 38 is then inserted into the end of the back-shell 40 and welded or staked 42 in place thereby providing an integral assembly with the connector and provide an electrical connection from the metallic shield 30 to the back-shell 40. An aperture 44 is provided in the back-shell 40 through which a potting compound 46 is inserted into the interior portion of the back-shell 40. The purpose of the potting compound 46 is not only to secure the wires 28 into the connector but it also adheres to and secures the braided tail 34 of the first cover 26 and retains it in place. After the potting compound 46 is inserted into the back-shell 40 the aperture 44 is sealed or closed by a means 48 such as a rivet fabricated from the same material as the back-shell. Next, the complete back-shell assembly is encased or moulded in a rubber-like compound 50 such as Viton rubber, to immobilize the cable 24 to resist vibration fatigue.

Figure 2:
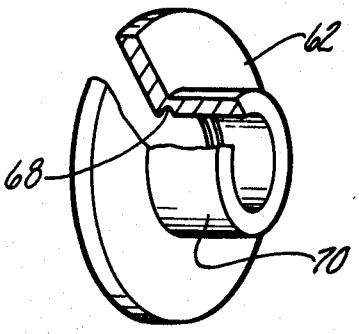
FIG. 2 is a perspective view partially in section illustrating the strain relief means in FIG. 1.
Figure 3:
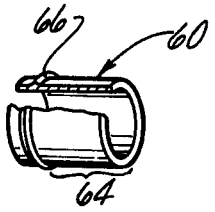
FIG. 3 is a perspective view, partially in section, illustrating a clamp which cooperates with the means of FIG. 2 as illustrated in FIG. 1.

FIGS. 2 and 3 illustrate the separate members of the strain relief means 38 which comprises a ferrule member 60 which encircles the cable 24 between the first 26 and second 30 covers and a ferrule clamping member 62 which functions to compress the second braided cover 30 onto the ferrule member 60 and in addition, both cooperate to function as a strain relief means 38 and to close the back-shell 40. The interior diameter of the ferrule member 60 is equal to or substantially equal to the diameter of the first cover 26 over the cable 24. The ferrule member 60 is a cylindrical member and has an extending shoulder 64 for distributing the clamping forces so as not to damage the cable 24. At one end of the ferrule member 60 is an external ring 66 which functions as one-half of a clamp. As illustrated in FIG. 1 the ferrule member 60 is positioned between the two covers 26 and 30 of the cable 24 and is positioned on the cable 24 at any time prior the assembly of the cable to the connector and perferably prior to applying the braided cover 30 to the cable 24.

FIG. 2 illustrates the ferrule clamping member 62 which cooperates with the ferrule member 60 of FIG. 3. The ferrule clamping member 62 functions as the strain relief means through the mating ring groove 68 at one end, which groove 68 forms the remaining one-half of a clamp and mates with the external ring 66 on the ferrule member 60 of FIG. 3 to hold the cable 24 into the connector. In addition, the ferrule clamping member 62 has an extending shoulder 60 for distributing the clamping forces on the ferrule member 60. In FIG. 2 the ferrule clamping member 62 is illustrated as being one piece, however for ease of assembly to the cable 24, the ferrule clamping member should be in two symetrical pieces.

As previously indicated, once the cable 24 is secured to the connector body, the strain relief means 38 is fastened to the back-shell 40 by fastening method such as welding, brazing or staking 42. Next, the overall assembly is then potted and encapsulated with a rubber moulding or boot 50 which encloses the back-shell 40, the aperture closing means 48 and the strain relief means 38, further securing the cable 24 from vibration fatigue.

It is to be understood that while FIG. 1 illustrates a straight back-shell, the present invention is also applicable to a 90° back-shell. The strength of the connection of the cable 24 to the housing and the completeness of the EMI shielding makes such a 90° back-shell very practical in close areas.

I claim:

1. An EMI shielded connector assembly comprising a cable connector body, a cable having at least a first cover overlying jacketed wires and terminating in a braided tail, a second braided cover overlying the first cover, the jacketed wires extending beyond the first and second covers and inserted in the connector body; and a back-shell receiving the cable at one end and pressed fit to the connector body at the other end, the back-shell having an aperture therein adapted to receive potting compound within the shell; characterized by a ferrule member encircling the cable between the first cover and the second cover;

a ferrule clamping member compressing the second cover to said ferrule member forming an interference fit;

means securing said ferrule clamping member to the back-shell;

potting compound filling the interior of the back-shell and securing the tail of the first cover and the jackets of the wires therein; and means closing the aperture and with the back-shell and said ferrule clamping member forming an EMI shield over the cable and connector body.

2. An EMI shielded connector assembly for a cable connector according to claim 1 wherein said ferrule member and said ferrule clamping member each have an extended shoulder thereon for distributing the clamping forces being applied by said ferrule clamping member compressing the second braided cover on said ferrule member.

3. An EMI shielded connector assembly for a cable connector according to claim 1 or 2 additionally including a molded rubber boot encapsulating the back-shell and said closing means for sealingly encircling the cable where it is received therein.

4. An EMI shielded connector assembly for a cable connector according to claim 1 or 2 wherein the first cover is formed by braiding polytetrafluoroethylene coated fiberglass thread around the jacketed wires.

5. An EMI shielded connector assembly for a cable connector according to claim 4 wherein the second cover is formed by braiding nickel wire around the first cover.

* * * * *